US010260454B2

(12) United States Patent
Suzuki et al.

(10) Patent No.: US 10,260,454 B2
(45) Date of Patent: Apr. 16, 2019

(54) CRANKSHAFT SUPPORT STRUCTURE

(71) Applicant: HONDA MOTOR CO., LTD., Tokyo (JP)

(72) Inventors: Noriyuki Suzuki, Wako (JP); Hiroshi Yokota, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 59 days.

(21) Appl. No.: 15/443,317

(22) Filed: Feb. 27, 2017

(65) Prior Publication Data

US 2017/0284335 A1 Oct. 5, 2017

(30) Foreign Application Priority Data

Mar. 30, 2016 (JP) ..... 2016-067991

(51) Int. Cl.
*F02F 7/00* (2006.01)
*F02B 61/02* (2006.01)

(52) U.S. Cl.
CPC ..... *F02F 7/0021* (2013.01); *F02F 7/0053* (2013.01); *F02F 7/0095* (2013.01); *F02B 61/02* (2013.01); *F02F 2007/0041* (2013.01); *F02F 2200/00* (2013.01)

(58) Field of Classification Search
CPC ..... F02F 7/0021; F02F 7/0053; F02F 7/0095; F02F 2007/0056
See application file for complete search history.

(56) References Cited

FOREIGN PATENT DOCUMENTS

| | | | |
|---|---|---|---|
| JP | 62-102019 U | | 6/1987 |
| JP | 11-230150 A | | 8/1999 |
| JP | 2005-330925 A | | 12/2005 |
| JP | 2005330925 A | * | 12/2005 |
| JP | 4228991 B2 | | 2/2009 |
| JP | 5506648 B2 | | 5/2014 |

OTHER PUBLICATIONS

Japanese Notification of Reasons for Refusal dated Jan. 23, 2018 for corresponding Japanese Application No. 2016-067991, with machine translation.

* cited by examiner

*Primary Examiner* — Jacob M Amick
(74) *Attorney, Agent, or Firm* — Birch, Stewart, Kolasch & Birch, LLP

(57) ABSTRACT

A first angle portion where part of a bearing cap side wall portion is cut out and a second angle portion where part of a bearing cap bottom surface portion is cut out are formed in a region (an angle region of a bearing cap) including a part where respective extension portions of the bearing cap side wall portion and the bearing cap bottom surface portion intersect each other, and a gap is provided between the crankcase side wall portion of a journal wall and the first angle portion and between a crankcase bottom surface portion and the second angle portion.

12 Claims, 7 Drawing Sheets

CRANKSHAFT SUPPORT STRUCTURE

INCORPORATION BY REFERENCE

The present application claims priority under 35 U.S.C. § 119 to Japanese Patent Application No. 2016-067991 filed on Mar. 30, 2016. The content of the applications is incorporated herein by reference in its entirety.

TECHNICAL FIELD

The present invention relates to a crankshaft support structure.

BACKGROUND ART

As a crankshaft support structure, there has been known a structure in which a steel-made bearing cap is fixed to an aluminum alloy-made crankcase by bolts, and a crankshaft is rotatably supported between the crankcase and the bearing cap.

In the case where the crankcase and the bearing cap are fixed to each other by only bolts, the difference in material may lead to stress concentration being generated upon vibrations arising from the rotation of the crankshaft.

In relation to automobile engines, there has been disclosed a structure in which a bearing cap is press fitted in order to restrain the above-mentioned vibrations (see, for example, Patent Document 1). In addition, there has also been disclosed a structure in which a crankcase is formed with an arcuate recess in order to reduce stress concentration of loads arising from the rotation of the crankshaft (see, for example, Patent Documents 2 and 3).

PRIOR ART DOCUMENTS

Patent Documents

[Patent Document 1]
Japanese Utility Model Laid-Open No. Sho 62-102019
[Patent Document 2]
Japanese Patent No. 4228991
[Patent Document 3]
Japanese Patent No. 5506648

SUMMARY OF THE INVENTION

Problem to be Solved by the Invention

In the conventional configurations, however, crankcase side wall portions where the load of press fitting the bearing cap is exerted on the crankcase make contact with angle portions of the bearing cap. Therefore, there has been a possibility of stress concentration on the crankcase side wall portions or the like being generated upon vibrations or the like arising from the rotation of the crankshaft.

In view of the foregoing, it is an object of the present invention to provide a crankshaft support structure by which stress concentration on crankcase side wall portions or the like can be restrained.

Means for Solving the Problem

In order to achieve the above object, according to an aspect of the present invention, there is provided a crankshaft support structure including a bearing cap (31) press fitted and fastened to a crankcase (12), with a crankshaft (15) rotatably supported between the crankcase (12) and the bearing cap (31), wherein the bearing cap (31) includes a bearing cap side wall portion (36) such that a press-fit load is exerted between the crankcase (12) and the bearing cap side wall portion (36) when the bearing cap (31) is press fitted to the crankcase (12), and a bearing cap bottom surface portion (34) making contact with the crankcase (12) when the bearing cap (31) is press fitted to the crankcase (12). In addition, a first angle portion (31X) where part of the bearing cap side wall portion (36) is cut out and a second angle portion (31Y) where part of the bearing cap bottom surface portion (34) is cut out are formed in a region (AR1) including a part where respective extension portions of the bearing cap side wall portion (36) and the bearing cap bottom surface portion (34) intersect each other. Besides, the crankcase (12) includes a crankcase side wall portion (26) making contact with the bearing cap side wall portion (36), and a crankcase bottom surface portion (24) making contact with the bearing cap bottom surface portion (34), with a gap (S) provided between the crankcase side wall portion (26) and the first angle portion (31X) and between the crankcase bottom surface portion (24) and the second angle portion (31Y).

In the configuration as above, a configuration may be adopted wherein the crankcase (12) is formed with a cutout portion (61) having an arcuate portion (61A) cut out in an arcuate shape such as to secure separated distances from the first angle portion (31X) and the second angle portion (31Y), the cutout portion (61) formed in a part where respective extension portions of the crankcase side wall portion (26) and the crankcase bottom surface portion (24) intersect each other, and that portion of the cutout portion (61) which interconnects the crankcase side wall portion (26) and the arcuate portion (61A) has a rectilinear portion (61B) having a rectilinearly cut-out shape.

In addition, in the configuration as above, that portion of the cutout portion (61) which interconnects the crankcase bottom surface portion (24) and the arcuate portion (61A) may have another rectilinear portion (61C) having a rectilinearly cut-out shape.

Besides, in the configuration as above, the rectilinear portion (61B) may be connected to the crankcase side wall portion (26) at a position spaced from the first angle portion (31X) more than a circular arc obtained by extending the arcuate portion (61A).

Further, in the configuration as above, the other rectilinear portion (61C) may be connected to the crankcase bottom surface portion (24) at a position spaced from the second angle portion (31Y) more than a circular arc obtained by extending the arcuate portion (61A).

In addition, in the configuration as above, the bearing cap (31) may have a bolt hole (33B) an axial direction of which is along a direction in which the bearing cap (31) is press fitted to the crankcase (12).

Besides, in the configuration as above, a configuration may be adopted wherein the bolt hole (33B) is coaxial with a through-hole portion (33) through which a fastening bolt (41) for fastening the bearing cap (31) and the crankcase (12) to each other is passed, and the bolt hole (33B) is greater in diameter than the fastening bolt (41).

Effects of the Invention

According to the aspect of the present invention, in the region including the part where the extension portion of the bearing cap side wall portion which receives the press-in load exerted between the bearing cap and the crankcase and the extension portion of the bearing cap bottom surface portion which makes contact with the crankcase intersect each other, there are formed the first angle portion where part of the bearing cap side wall portion is cut out and the second angle portion where part of the bearing cap bottom surface portion is cut out. In addition, the crankcase has a gap between the crankcase side wall portion making contact with the bearing cap side wall portion and the first angle portion, and between the crankcase bottom surface portion making contact with the bearing cap bottom surface portion and the second angle portion. By these configurations, contact between the angle region of the bearing cap and the corner region of the crankcase can be obviated, and stress concentration on the crankcase side wall portion or the like can be restrained.

Besides, in the crankcase, the cutout portion having the arcuate portion cut out in an arcuate shape such as to secure separated distances from the first angle portion and the second angle portion is formed in the part where the respective extension portions of the crankcase side wall portion and the crankcase bottom surface portion intersect each other. By this, stress concentration in the region of the arcuate portion can be reduced. Further, that portion of the cutout portion which interconnects the crankcase side wall portion and the arcuate portion has the rectilinear portion having a rectilinearly cut-out shape, and, therefore, the arcuate portion can be reduced in radius and set closer to the first angle portion while securing the separated distance. Accordingly, space savings can be achieved as to the internal volume of the cutout portion, and it is facilitated to secure the rigidity of the crankcase.

In addition, that portion of the cutout portion which interconnects the crankcase bottom surface portion and the arcuate portion has another rectilinear portion having a rectilinearly cut-out shape. By this, the arcuate portion can be reduced in radius and set closer to the second angle portion while securing the separated distance. Accordingly, space savings can be achieved in regard of the internal volume of the cutout portion, and it becomes easy to secure the rigidity of the crankcase.

Further, the rectilinear portion is connected to the crankcase side wall portion at a position spaced from the first angle portion more than the circular arc obtained by extending the arcuate portion, and, therefore it becomes easy to secure the separated distance from the first angle portion and the surroundings thereof, which contributes to space savings as to the internal volume of the cutout portion.

In addition, the another rectilinear portion is connected to the crankcase bottom surface portion at a position spaced from the second angle portion more than the circular arc obtained by extending the arcuate portion, and, therefore, it is facilitated to secure the separated distance from the second angle portion and the surroundings thereof, which contributes to space savings in regard of the internal volume of the cutout portion.

Besides, the bearing cap has the bolt hole the axial direction of which is along a direction in which the bearing cap is press fitted to the crankcase, and, therefore, when the press-fitted bearing cap is drawn out, the fastening bolt for grasping the bearing cap can be fastened.

Furthermore, the bolt hole is coaxial with the through-hole portion through which the fastening bolt for fastening the bearing cap and the crankcase to each other is passed and the bolt hole is greater in diameter than the fastening bolt, and, therefore, the through-hole portion and the bolt hole can be provided on a combined use basis. Accordingly, it becomes easy to maintain the rigidity of the bearing cap.

BRIEF DESCRIPTION OF THE DRAWINGS

FIG. 6 is a perspective view depicting an attaching/detaching jig together with the bearing cap and the like.

FIG. 7 is a sectional view depicting the attaching/detaching jig together with the bearing cap and the like.

MODE FOR CARRYING OUT THE INVENTION

Figure 1:
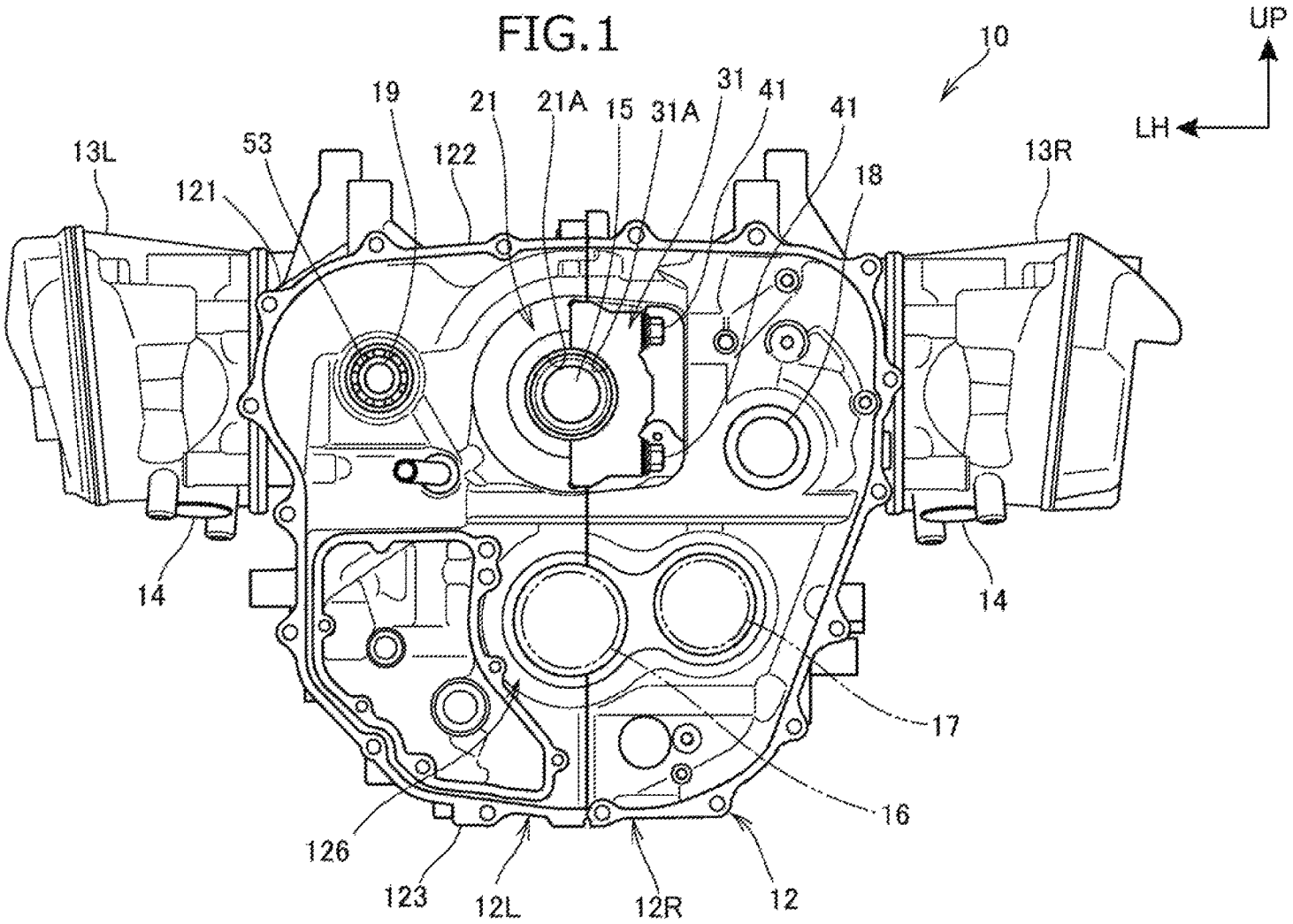
FIG. 1 is a view, as viewed from the rear side, of a power unit having a crankshaft support structure according to the present invention.

An embodiment of the present invention will be described below, referring to the drawings.

FIG. 1 is a view, as viewed from the rear side, of a power unit having a crankshaft support structure according to the present invention. A power unit 10 is a unit which is mounted on a motorcycle to drive a rear wheel (driving wheel) of the motorcycle, and which is also called engine. Note that in the following description, the sides such as front, rear, left, and right sides are sides (or directions) in the state where components are mounted on the motorcycle. In addition, symbol UP depicted in each drawing indicates the upper side of the vehicle, and symbol LH indicates the left-hand side.

The power unit 10 has a horizontal opposed type internal combustion engine which includes a crankcase 12, and a pair of cylinder blocks 13L and 13R projecting to the left and right sides from the crankcase 12. Each of the cylinder blocks 13L and 13R is provided with three cylinders which are arrayed in the longitudinal vehicle direction. In other words, the power unit 10 is configured as a horizontal opposed six-cylinder engine.

An intake manifold communicating with each of the cylinders is provided at an upper surface of each cylinder block 13L or 13R, and an air cleaner is connected to each intake manifold. In addition, an exhaust port communicating with each of the cylinders is provided at a lower surface of each cylinder block 13L or 13R, and an exhaust pipe is connected to each exhaust port 14.

The crankcase 12 is composed of two blocks 12L and 12R into which the crankcase 12 is divided at the center in regard of the left-right direction (transverse direction). Hereinafter, the block 12L on the left side of the crankcase 12 will be referred to as "the left case half 12L," and the block 12R on the right side as "the right case half 12R."

Note that FIG. 1 illustrates a state in which a cover connected to a rear portion of the crankcase 12 is removed, so that the crankcase 15 and the like accommodated inside can be visually confirmed. The crankcase 12 and the cylinder blocks 13L and 13R are made of an aluminum alloy.

On the crankcase 12, a crankshaft 15 extending in the longitudinal vehicle direction is rotatably supported, at a position corresponding to a mating surface of the left and right case halves 12L and 12R (at a central position in regard of the left-right direction). In addition, a main shaft 16, a counter shaft 17, an output shaft 18, and a generator shaft 19 are further rotatably supported on the crankcase 12.

The main shaft 16 is a shaft member which is disposed in parallel to the crankshaft 15 under the crankshaft 15, and to which rotation of the crankshaft 15 is transmitted. The counter shaft 17 is a shaft member which is disposed in parallel to the main shaft 16 on the right side of the main shaft 16, and to which rotation of the main shaft 16 is transmitted at a transmission gear ratio corresponding to a current gear position.

The output shaft 18 is a shaft member which is disposed in parallel to the counter shaft 17 on a right upper side of the counter shaft 17, and to which rotation of the counter shaft 17 is transmitted. The output shaft 18 is exposed to the outside of the power unit 10, and drives the rear wheel through a power transmission mechanism (not depicted). A clutch mechanism is provided in a power transmission path extending from the crankshaft 15 to the output shaft 18, and power transmission can be effected and cut off in a switched manner by the clutch mechanism.

The generator shaft 19 is a shaft member which is disposed in parallel to the crankshaft 15 on the left side of the crankshaft 15. Rotation of the crankshaft 15 is transmitted to the generator shaft 19, whereby electric power is generated through a power generation mechanism (not depicted). The electric power is used, for example, for charging of a battery which supplies electric power to parts of the vehicle body.

Now, a support structure for the crankshaft 15 will be described below.

The crankshaft 15 is rotatably supported by journal walls (also referred to as crankshaft holders) 21 formed in the left case half 12L, and a bearing cap 31 fixed to the journal walls 21.

Figure 2:
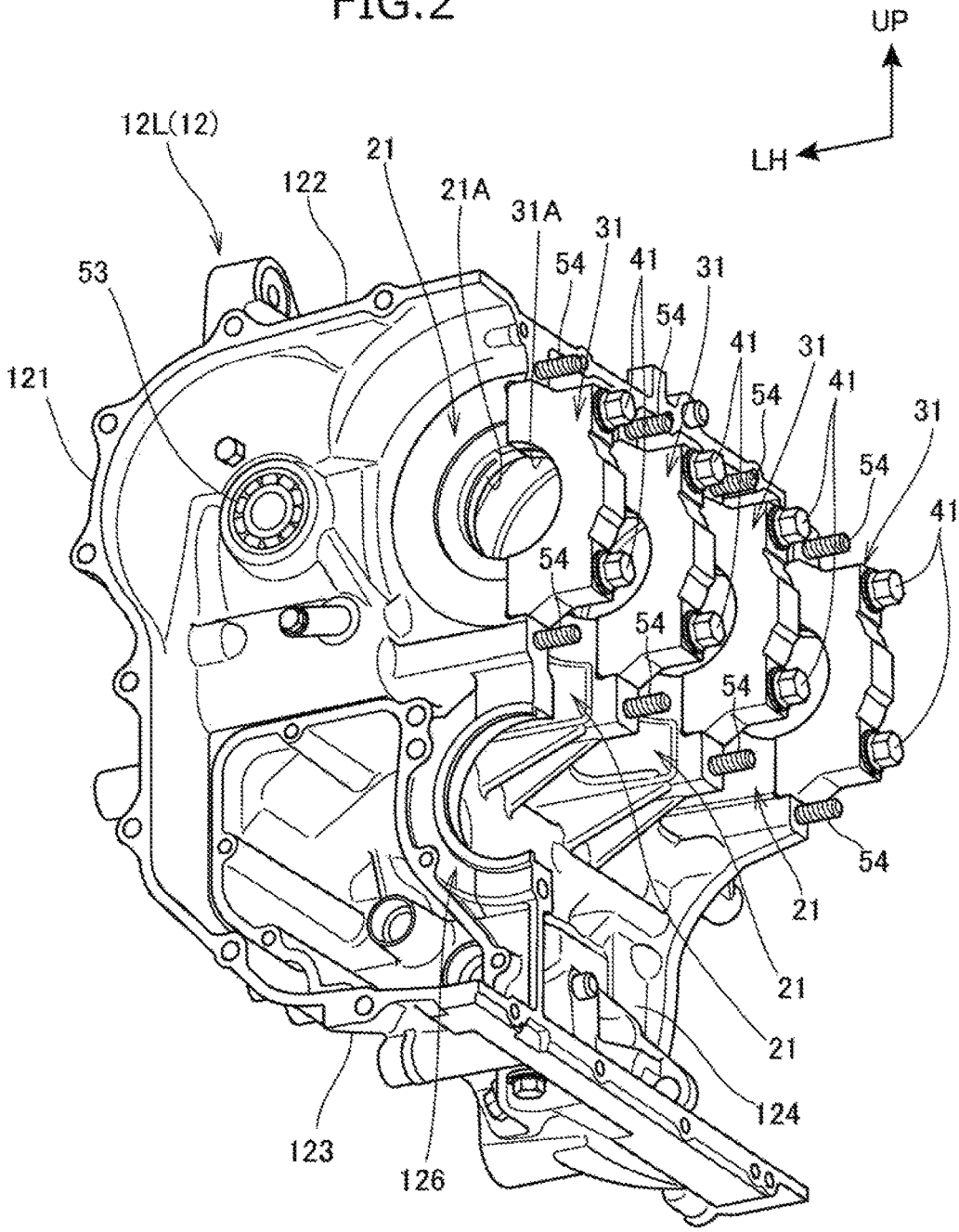
FIG. 2 is a perspective view of a left case half of a crankcase.

FIG. 2 is a perspective view of the left case half 12L of the crankcase 12.

As illustrated in FIG. 2, the journal walls 21 are provided to be integral with the left case half 12L and are spaced apart in the longitudinal vehicle direction; in this configuration, four journal walls 21 are provided at intervals in the longitudinal vehicle direction. The bearing cap 31 is fastened to each of the journal walls 21 by fastening bolts 41, which are each pair of fastening parts.

When the bearing cap 31 is fastened to each journal wall 21, semi-circular recessed portions 21A and 31A formed individually in them define a true circular through-hole, and the crankshaft 15 is inserted in the through-hole. Between the through-hole and the crankshaft 15, there is interposed a metal bearing 51 (see FIG. 3, described later).

As depicted in FIG. 2, the left case half 12L integrally includes a side wall portion 121 constituting a surface on an outside in regard of the transverse direction, an upper plate portion 122 constituting an upper surface, and a bottom plate portion 123 constituting a bottom surface, and integrally includes inner wall portions 124 disposed at inside parts. The left case half 12L is integrally formed by casting of an aluminum alloy, and the journal walls 21 are formed to be integral with the inner wall portions 124.

In FIG. 2, reference symbol 126 denotes a journal wall (also referred to as main shaft holder) that supports the main shaft 16, and the journal wall 126 is also formed to be integral with the left case half 12L. Reference symbol 53 denotes a bearing (for example, roller bearing) that rotatably supports the generator shaft 19. In addition, reference symbol 54 denotes each of fastening bolts which are fastening parts for fastening the left case half 12L and the right case half 12R in the vicinity of the crankshaft 15.

Figure 3:
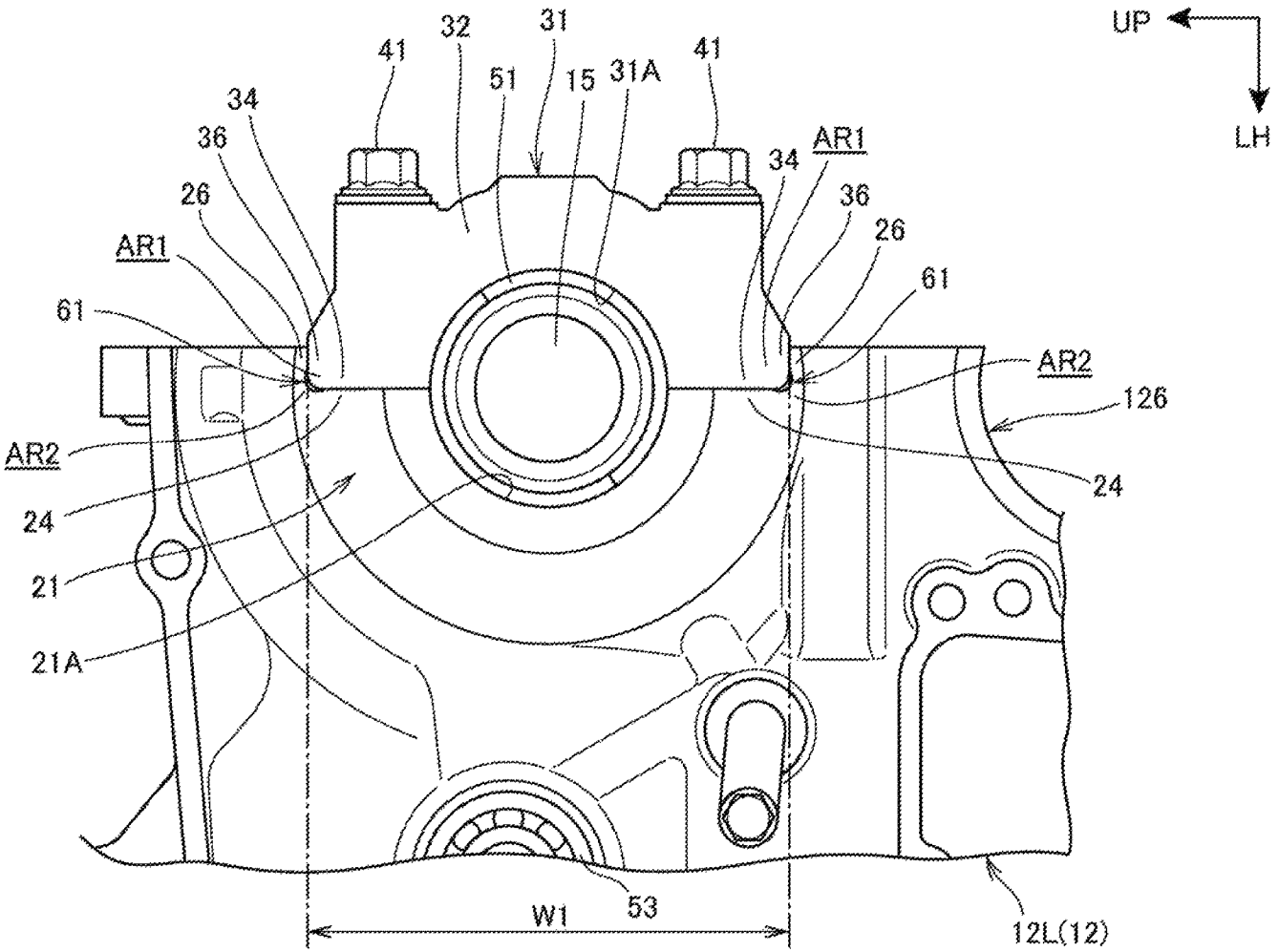
FIG. 3 illustrates a state in which a journal wall and a bearing cap are coupled to each other.
Figure 4:
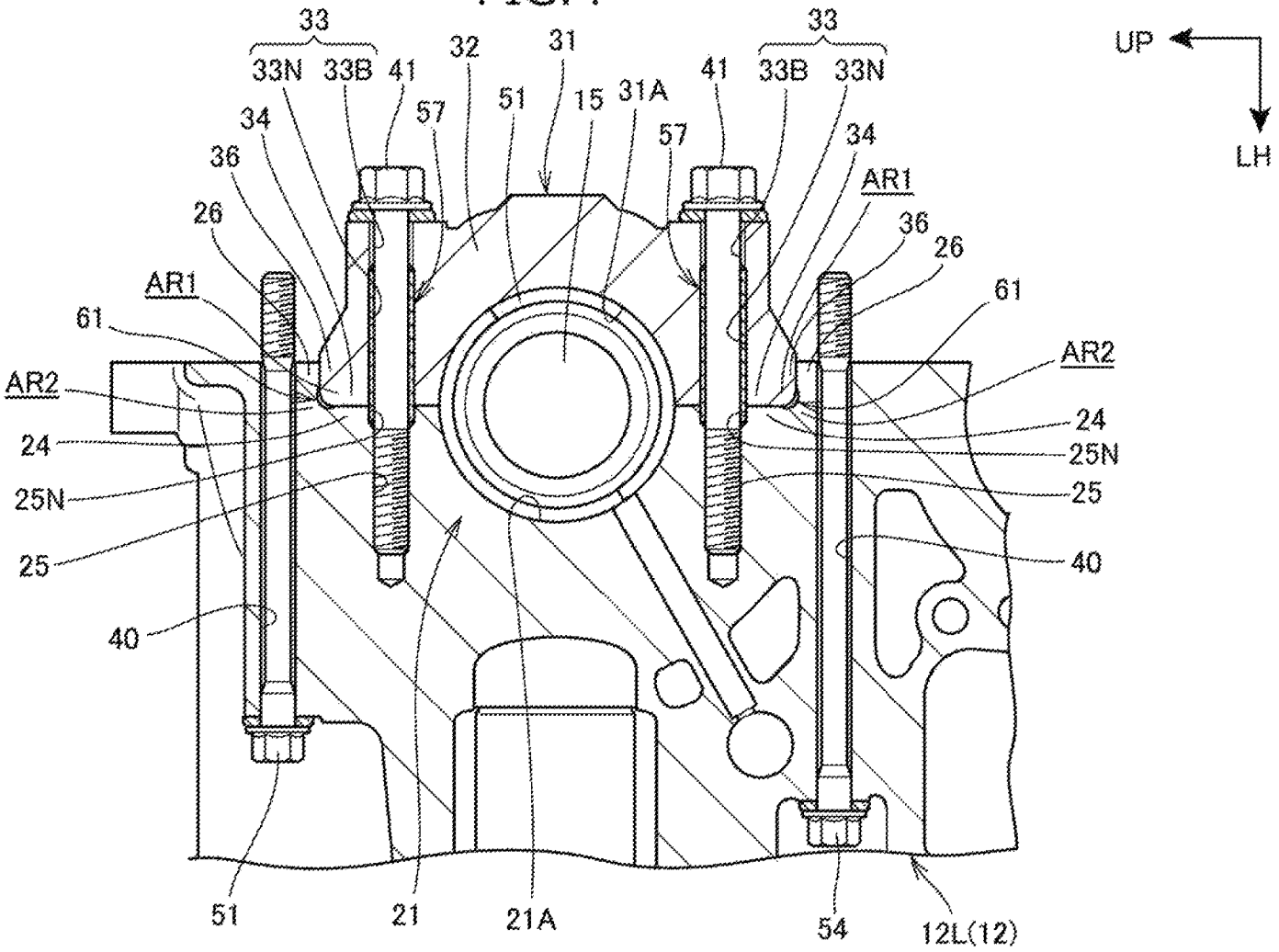
FIG. 4 is a sectional view depicting an inside structure of FIG. 3.

FIG. 3 illustrates a state in which the journal wall 21 and the bearing cap 31 are coupled to each other, and FIG. 4 is a sectional view depicting an inside structure of FIG. 3.

The bearing cap 31 is formed from a steel material. In the present embodiment, the bearing cap 31 is formed of an iron-based material which is lower in coefficient of thermal expansion than the crankcase 12 and which is higher in hardness than the crankcase 12.

The bearing cap 31 is produced by integrally providing a steel-made bearing cap main body 32 with: a pair of through-hole portions 33 through which fastening bolts 41 for fastening the bearing cap 31 to the journal wall 21 are passed; a pair of bottom surface portions 34 for contact with a joint surface of the journal wall 21; and a recessed portion 31A recessed in a semi-circular shape between the pair of bottom surface portions 34.

Hereinafter, the bottom surface portion 34 of the bearing cap 31 will be referred to as "the bearing cap bottom surface portion 34," and the joint surface of the journal wall 21, or a surface making contact with the bearing cap bottom surface portion 34 will be referred to as "the crankcase bottom surface portion 24."

The bearing cap bottom surface portion 34 and the crankcase bottom surface portion 24 are formed as flat surfaces, and they make surface contact with each other when the bearing cap 31 is fastened to the crankcase 12 (the journal walls 21), whereby fastening with a strong fastening force can be achieved.

The journal wall 21 integrally includes: a pair of the crankcase bottom surface portions 24 contacted respectively by a pair of the bearing cap bottom surface portions 34; a recessed portion 21A recessed in a semi-circular shape between the pair of crankcase bottom surface portions 24; and a female screw portion 25 communicating with the through-hole portion 33 of the bearing cap 31. The female screw portion 25 is put into screw engagement with the fastening bolt 41.

In addition, the journal wall 21 also includes a pair of through-hole portions 40 through which a pair of fastening bolts 54 for fastening the left case half 12L and the right case half 12R together are passed.

As depicted in FIG. 4, the bearing cap 31 and the journal wall 21 are formed with knocking pin hole portions 33N and 25N (hereinafter referred to as knock holes 33N and 25N) in their regions opposed to each other with the joint surface therebetween. The knock hole 33N of the bearing cap 31 is formed coaxially with the through-hole portion 33, by enlarging the diameter of a region ranging from an intermediate part of the through-hole portion 33 to the bearing cap bottom surface portion 34.

In addition, the knock hole 25N of the journal wall 21 is formed coaxially with the female screw portion 35, by enlarging the diameter of that region of the female screw portion 35 which is located in the crankcase bottom surface portion 24.

The knock holes 33N and 25N communicate with each other at a position where the bearing cap 31 and the journal wall 21 are fastened together. In the knock holes 33N and 25N, a single knock pin 57 is inserted. The bearing cap 31 and the journal wall 21 are positioned by the knock pin 57.

The knock pin 57 is a hollow cylindrical part (also referred to as split knock pin) having a C-shaped cross section such as to permit the fastening bolt 41 to be inserted therein. In this configuration, positioning is conducted at two positions by use of two such knock pins 57, so that the bearing cap 31 and the journal wall 21 can be positioned with an enhanced accuracy.

Furthermore, the journal wall 21 is integrally formed with a press-fit portion into which the bearing cap 31 is to be press fitted, by a structure wherein outside portions (the portions denoted by reference symbol 26 in FIG. 3) of the pair of crankcase bottom surface portions 24 are projected toward the right case half 12R side.

Specifically, the interval between the pair of outside portions 26 constituting the press-fit portions is formed to be narrower than a width W1 (FIG. 3) of the bearing cap 31, and the bearing cap 31 is press fitted into the width W1. By the press fitting, the joining strength between the bearing cap 31 and the journal wall 21 is enhanced, and it is made easier to restrain vibrations due to the rotation of the crankshaft 15.

The outside portions 26 present on the crankcase 12 side function as side walls at the time of press fitting of the bearing cap 31 therebetween, and, therefore, they will hereinafter be referred to as "the crankcase side wall portions 26." In addition, the regions of the bearing cap 31 that correspond to the inner sides of the crankcase side wall portions 26, or the regions where a press-fit load acts between the bearing cap 31 and the crankcase 12, will hereinafter be referred to as "the bearing cap side wall portions 36."

Besides, a region AR1 where respective extension portions of the bearing cap bottom surface portion 34 and the bearing cap side wall portion 36 of the bearing cap 31 intersect each other will be referred to as "the angle region AR1 of the bearing cap." Note that the region AR1 is not limited to the part where the extensions intersect, but includes the vicinity of the part.

In addition, a region AR2 where respective extension portions of the crankcase bottom surface portion 24 and the crankcase side wall portion 26 of the journal wall 21 intersect each other will be referred to as "the corner region AR2 of the journal wall 21." The region AR2 is also not limited to the part where the extensions intersect, but includes the vicinity of the part.

Figure 5:
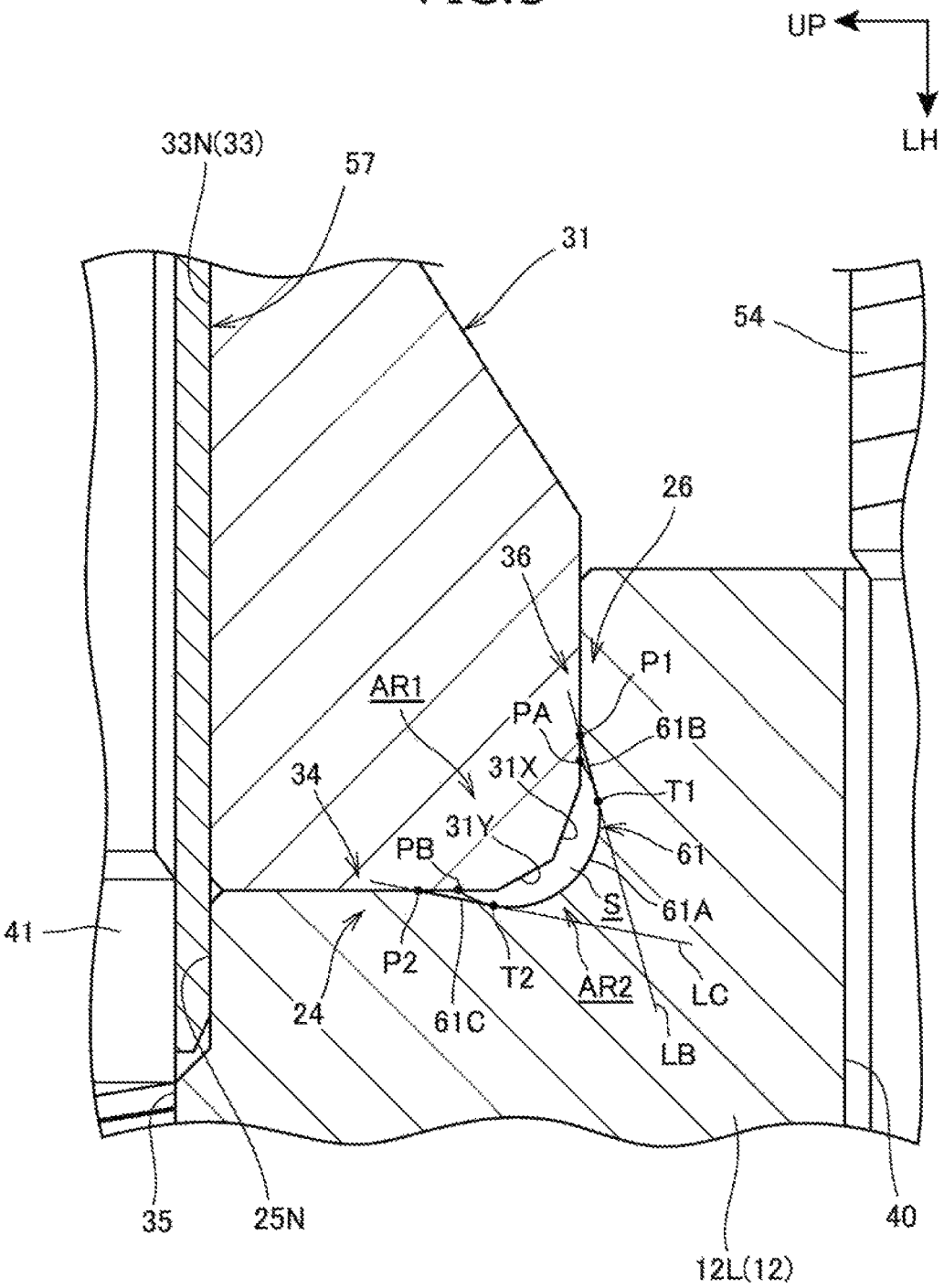
FIG. 5 is an enlarged view of part of FIG. 4.

FIG. 5 is an enlarged view of part of FIG. 4, depicting a region which corresponds to the angle region AR1 of the bearing cap 31 and the corner region AR2 of the journal wall 21.

As illustrated in FIG. 5, a gap S is formed between the angle region AR1 of the bearing cap 31 and the corner region AR2 of the journal wall 21. By the gap S, stress concentration which might be generated due to the contact between the angle region AR1 and the corner region AR2 is restrained. The configuration associated with the gap S will be described below.

In the angle region AR1 of the bearing cap 31, there are formed a first angle portion 31X where part of the bearing cap side wall portion 36 is cut out, and a second angle portion 31Y where part of the bearing cap bottom surface portion 34 is cut out. Specifically, the first angle portion 31X is formed by a method where part of the bearing cap side wall portion 36 is cut out obliquely rectilinearly. In addition, the second angle portion 31Y is formed by a method in which part of the bearing cap bottom surface portion 34 is cut out obliquely rectilinearly.

By the formation of the plurality of angle portions consisting of the first angle portion 31X and the second angle portion 31Y, it is made easier to secure a gap between the angle region AR1 of the bearing cap 31 and the corner region AR2 of the journal wall 21, over a wide range between the first angle portion 31X and the second angle portion 31Y.

Moreover, since the plurality of angle portions are formed, the cutting amount relevant to the angle region AR1 can be reduced, as compared to the case where the whole part of the angle region AR1 is cut obliquely at a fixed angle. As a result, it is facilitated to secure the rigidity of the bearing cap 31.

In addition, since the first angle portion 31X and the second angle portion 31Y are formed by cutting out rectilinearly, processing such as cutting is easy to carry out. Further, it is also easy to finely adjust the shapes of the first angle portion 31X and the second angle portion 31Y by regulating the angles of cutting-out. In this configuration, the angles of cutting-out for forming the first angle portion 31X and the second angle portion 31Y are set to or around 30 degrees, whereby the cutting amount can be suppressed while securing the gap over a wide range.

In addition, a cutout portion 61 in such a cut-out shape as to be separated from the first angle portion 31X and the second angle portion 31Y is formed in the corner region AR2 of the journal wall 21, wherein the gap between the angle region AR1 of the bearing cap 31 and the corner region AR2 of the journal wall 21 is broadened.

The cutout portion 61 integrally includes an arcuate portion 61A cut out in an arcuate shape such as to secure the gap S in relation to the first angle portion 31X and the second angle portion 31Y, a first cutout portion 61B having such a cut-out shape as to interconnect the arcuate portion 61A and the crankcase side wall portion 26, and a second cutout portion 61C having a cut-out shape such as to interconnect the arcuate portion 61A and the crankcase bottom surface portion 24.

More specifically, the arcuate portion 61A is formed along a circular arc which is curved toward the side for spacing away from the first angle portion 31X and the second angle portion 31Y. This circular arc is a circular arc for securing separated distances from the first angle portion 31X and the second angle portion 31Y. The separated distances are such distances as to avoid contact with the journal wall 21, even in the case where the first angle portion 31X and the second angle portion 31Y are vibrated due to the rotation of the crankshaft 15, or even in the case where a difference in thermal expansion amount is generated between the journal wall 21 and the bearing cap 31.

By the provision of the arcuate portion 61A cut out in an arcuate shape, stress concentration can be restrained even if an external force is exerted on the arcuate portion 61A. The arcuate portion 61A is formed only in the region that is opposed to the first angle portion 31X and the second angle portion 31Y of the bearing cap 31. In other words, the arcuate portion 61A is connected with neither the side wall (the crankcase side wall portion 26) to which the bearing cap 31 is press fitted, nor the part (the crankcase bottom surface portion 24) to which the bearing cap 31 is fastened.

For instance, the arcuate portion 61A is made to be a cutout having a fixed curvature (or radius of curvature) which is the smallest within such a range as to avoid contact with the first angle portion 31X and the second angle portion 31Y, whereby minimized separated distances from the first angle portion 31X and the second angle portion 31Y are secured. Note that the shape of the arcuate portion 61A is not limited to a cutout with a fixed curvature (radius of curvature), but may be a cutout the curvature (radius of curvature) of which varies in its course within such a range as to secure a separated distance.

The first cutout portion 61B is formed as a rectilinear portion where part of the crankcase side wall portion 26 is cut out obliquely rectilinearly, in such a manner as to interconnect one end of the arcuate portion 61A and a position P1 on the crankcase side wall portion 26 that is spaced from the first angle portion 31X. Note that in FIG. 5, reference symbol LB denotes an extension line of a straight line of the first cutout portion 61B.

The first cutout portion 61B is formed by cutting out at a fixed inclination angle, and, therefore, it is easy to process. Moreover, by setting the angle of the cutout to or around 30 degrees, the cutting amount can be suppressed while securing the gap over a wide range.

In addition, the first cutout portion 61B is connected to the bearing cap side wall portion 36 at the position P1 (FIG. 5) which is spaced from the first angle portion 31X more than the circular arc (indicated by wavy line in FIG. 5) obtained by extending the arcuate portion 61A. Note that in FIG. 5, reference symbol PA denotes a position where the circular arc obtained by extending the arcuate portion 61A is connected to the bearing cap side wall portion 36.

Therefore, when the first cutout portion 61B is provided, a larger separated distance from the first angle portion 31X and the surroundings thereof can be secured, as compared to the case where only the arcuate portion 61A (inclusive of the wavy line part) is provided.

If it is intended to secure a separated distance equivalent to that obtained with the first cutout portion 61B by providing only the arcuate portion 61A, it would be necessary to make the arcuate portion 61A pass the position P1, which would lead to an increase in the radius of the arcuate portion 61A. As a result, the cutting amount for the crankcase side wall portion 26 would be increased, which is disadvantageous from the viewpoint of securing the rigidity of the journal wall 21.

Thus, in this configuration, the separated distance from the first angle portion 31X and the surroundings thereof is secured by use of the arcuate portion 61A and the first cutout portion 61B (which is a rectilinear cutout portion), and, therefore, the arcuate portion 61A can be reduced in radius and can be set closer to the first angle portion 31X. Accordingly, space savings can be achieved as to the cutout portion 61, and it is easy to secure the rigidity of the journal wall 21 even when the cutout portion 61 is formed.

The second cutout portion 61C is formed as a rectilinear portion where part of the crankcase bottom surface portion 24 is cut out obliquely rectilinearly, in such a manner as to interconnect another end T2 of the arcuate portion 61A and a position P2 (FIG. 5) on the crankcase bottom surface portion 24 that is spaced from the second angle portion 31Y. Note that in FIG. 5, reference symbol LC denotes an extension line of a straight line of the second cutout portion 61C.

Like the first cutout portion 61B, the second cutout portion 61C is formed by cutting out at a fixed inclination angle, and, therefore, it is easy to process. By setting the angle of cutting-out to or around 30 degrees, the cutting amount can be suppressed while securing the gap over a wide range.

The second cutout portion 61C is connected to the bearing cap bottom surface portion 34 at the position P2 which is spaced from the second angle portion 31Y more than the circular arc (indicated by wavy line in FIG. 5) obtained by extending the arcuate portion 61A. Note that in FIG. 5, reference symbol PB denotes a position where the circular arc obtained by extending the arcuate portion 61A is connected to the bearing cap bottom surface portion 34. Therefore, when the second cutout portion 61C is provided, a larger separated distance from the second angle portion 31Y and the surroundings thereof can be secured, as compared to the case where only the arcuate portion 61A (inclusive of the wavy line part) is provided.

In addition, if it is intended to secure a separated distance equivalent to that obtained with the second cutout portion 61C by providing only the arcuate portion 61A, it would be necessary to make the arcuate portion 61A pass the position P2, which would lead to an increase in the radius of the arcuate portion 61A, which, in turn, is disadvantageous from the viewpoint of securing the rigidity of the journal wall 21.

Accordingly, the separated distance from the second angle portion 31Y and the surroundings thereof is secured by use of the arcuate portion 61A and the second cutout portion 610 (which is a rectilinear cutout), whereby the cutting amount can be suppressed while securing the gap over a wide range, and it is made easier to secure the rigidity of the journal wall 21.

In addition, since the first cutout portion 61B and the second cutout portion 61C are formed by cutting out rectilinearly, processing such as cutting is easy to carry out. Further, it is also easy to finely adjust the shapes of the first cutout portion 61B and the second cutout portion 61C by regulating the angles of cutting-out.

Followingly, attachment and detachment of the bearing cap 31 will be described.

As depicted in FIG. 4, bolt holes 33B are provided coaxially with the through-hole portions 33 through which the pair of fastening bolts 41 for fastening the bearing cap 31 and the journal wall 21 to each other are passed. The bolt hole 33B is formed as a female screw larger in diameter than a shaft portion of the fastening bolt 41, and, therefore, does not hamper the insertion of the fastening bolt 41 into the through-hole portion 33. In addition, the bolt hole 33B is provided at an end portion of the through-hole portion 33 on the side opposite to the journal wall 21. Therefore, it is easy to additionally process the bolt holes 33B after the through-hole portions 33 are formed.

The bolt holes 33B have an axial direction along the direction in which the bearing cap 31 is to be press fitted to the journal wall 21. At the time of drawing out the bearing cap 31, part of an attaching/detaching jig 81 for attaching/detaching the bearing cap 31 is fixed to the bolt holes 33B.

Figure 6:
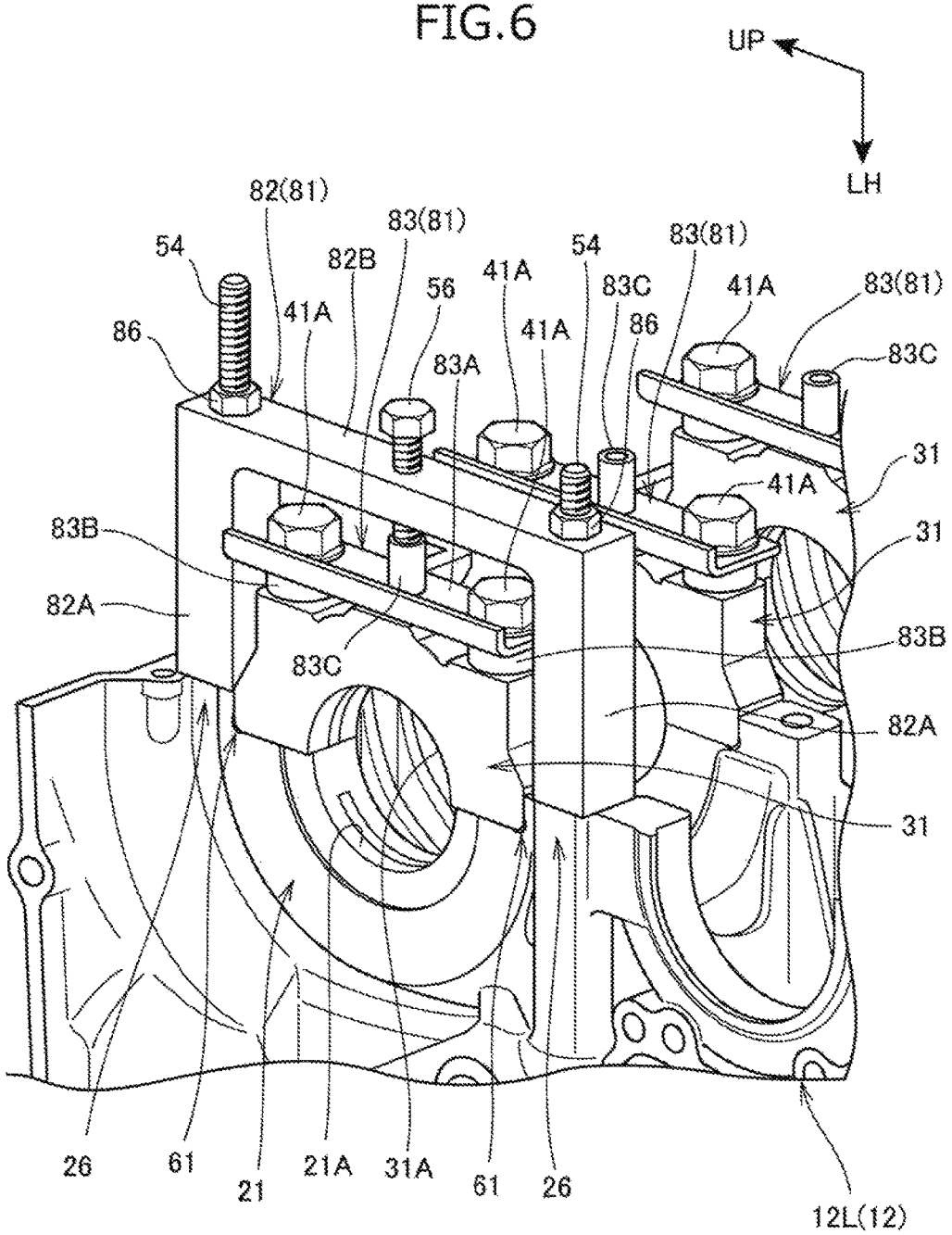
Figure 7:
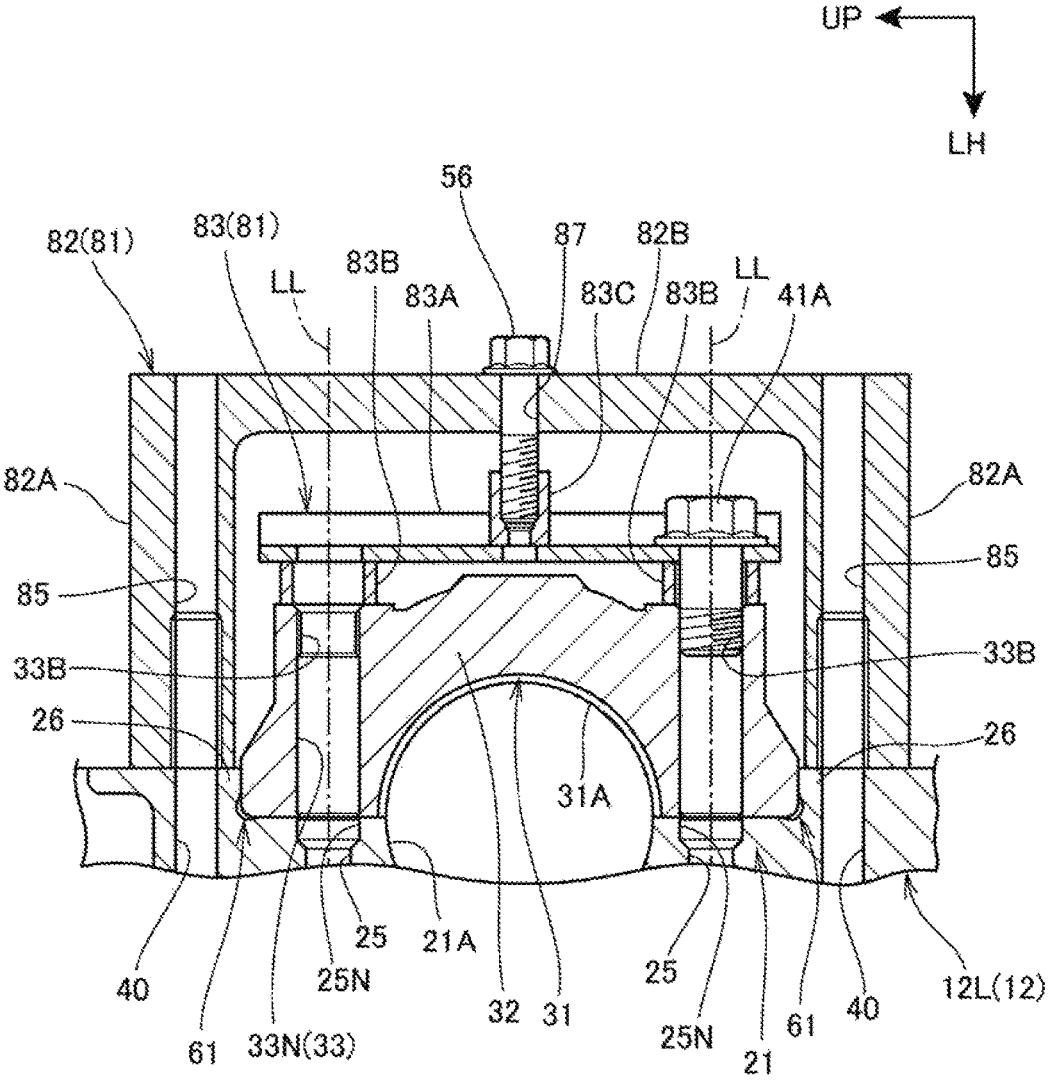

FIG. 6 is a perspective view depicting the attaching/detaching jig 81 together with the bearing cap 31 and the like, and FIG. 7 is a sectional view depicting the attaching/detaching jig 81 together with the bearing cap 31 and the like.

The attaching/detaching jig 81 includes a first jig 82 as a gate-shaped member mounted on those portions of the journal wall 21 which are located on both sides of the bearing cap 31, and a second jig 83 which is a member fixed to the bearing cap 31.

As depicted in FIGS. 6 and 7, those portions of the journal wall 21 which are located on both sides of the bearing cap 31 are the pair of crankcase side wall portions 26, and the first jig 82 is mounted on the crankcase side wall portions 26. In addition, the pair of crankcase side wall portions 26 are formed therein with through-hole portions 40 (FIG. 7) through which fastening bolts 54 (FIG. 6) for fastening the left case half 12L and the right case half 12R to each other are passed.

The first jig 82 integrally includes a pair of leg portions 82A mounted on the pair of crankcase side wall portions 26, and a connection portion 82B which interconnects those end portions of the leg portions 82A which are on the side opposite to the crankcase side wall portions 26. The pair of leg portions 82A are formed therein with through-hole portions 85 (hereinafter referred to as jig side hole portions 85) communicating with the through-hole portions 40 that penetrate the pair of crankcase side wall portions 26. As illustrated in FIGS. 6 and 7, the fastening bolts 54 are passed individually through the pair of jig side hole portions 85, and nuts 86 (FIG. 6) are fastened to tips of the fastening bolts 54, whereby the first jig 82 is fixed to the journal wall 21, or to the crankcase 12.

Besides, the connection portion 82B of the first jig 82 is formed therein with a through-hole portion 87 (hereinafter referred to as jig hole portion 87) into which a fastening bolt 56 is inserted toward the second jig 83.

The second jig 83 includes a plate portion 83A which is a plate-shaped part to be fastened to the bearing cap 31 by utilizing the pair of bolt holes 33B provided in the bearing cap 31.

The plate portion 83A is integrally provided with a pair of hollow cylindrical portions 83B permitting insertion thereinto of fastening bolts 41A which are fastening parts for fastening to the bolt holes 33B. These hollow cylindrical portions 83B serve also as leg portions for mounting the second jig 83 on the bearing cap 31. Note that the fastening bolts 41A are bolts different from the fastening bolts 41 for fastening the bearing cap 31 to the journal wall 21, and are greater in diameter than the fastening bolts 41.

The fastening bolts 41A are inserted individually in the hollow cylindrical portions 83B, and the fastening bolts 41A are fastened to the bolt holes 33B, whereby the second jig 83 is fixed to the bearing cap 31, as depicted in FIG. 6. Note that the fixation of the second jig 83 is carried out prior to mounting of the first jig 82 to the journal wall 21 (the crankcase 12).

The plate portion 83A is further provided with a hollow cylindrical fastened portion 83C to which the fastening bolt 56 penetrating the first jig 82 is fastened. An inside surface of the fastened portion 83C is formed as a female screw capable of screw engagement with the fastening bolt 56.

Accordingly, when the fastening bolt 56 is rotated in a fastening direction after the first jig 82 and the second jig 83 are assembled as depicted in FIGS. 5 and 6, the second jig 83 is drawn up toward the connection portion 82B, and the bearing cap 31 can be drawn out. Note that when the fastening bolt 56 is rotated oppositely to the fastening side (rotated to a loosening side), the second jig 83 can be moved toward the journal wall 21 side, and, therefore, the bearing cap 31 can be press fitted.

As has been described above, in the present embodiment, the first angle portion 31X where part of the bearing cap side wall portion 36 is cut out and the second angle portion 31Y where part of the bearing cap bottom surface portion 34 is cut out are formed in the region (the angle region AR1 of the bearing cap 31) including the part where the respective extension portions of the bearing cap side wall portion 36 and the bearing cap bottom surface portion 34 intersect each other. Further, the gap S exists between the crankcase side wall portion 26 of the journal wall 21 and the first angle portion 31X, and between the crankcase bottom surface portion 24 and the second angle portion 31Y. Owing to these configurations, contact between the angle region AR1 of the bearing cap 31 and the corner region AR2 of the journal wall 21 can be obviated, and stress concentration onto the crankcase side wall portion 26 or the like can be restrained.

In addition, in this configuration, the gap S is present between the bearing cap 31 and the journal wall 21 integral with the crankcase 12 which are formed from different materials. Consequently, contact between the bearing cap 31 and the crankcase 12 can be avoided, even in the presence of a difference in thermal expansion amount due to the difference in material, vibrations due to the rotation of the crankshaft 15, and the like.

Besides, the cutout portion 61 including the arcuate portion 61A cut out in an arcuate shape such as to secure separated distances from the first angle portion 31X and the second angle portion 31Y is formed in the part (the corner region AR2 of the journal wall 21) where the respective extension portions of the crankcase side wall portion 26 and the crankcase bottom surface portion 24 intersect each other. Accordingly, stress concentration in the region of the arcuate portion 61A can be reduced.

Moreover, that portion of the cutout portion 61 which interconnects the crankcase side wall portion 26 and the arcuate portion 61A is formed as the first cutout portion 61B which is a rectilinear portion obtained by cutting out rectilinearly, and, therefore, the arcuate portion 61A can be reduced in radius and set closer to the first angle portion 31X while securing the separated distance. Accordingly, space savings can be achieved in regard of the internal volume of the cutout portion 61, and it is facilitated to secure the rigidity of the crankcase 12.

In addition, that portion of the cutout portion 61 which interconnects the crankcase bottom surface portion 24 and the arcuate portion 61A is formed as the second cutout portion 61C which is another rectilinear portion obtained by cutting out rectilinearly. By this configuration, also, space savings can be achieved as to the internal volume of the cutout portion 61 while securing the separated distance, and it is made easy to secure the rigidity of the crankcase 12.

Furthermore, the first cutout portion 61B is connected to the crankcase side wall portion 26 at the position P1 spaced from the first angle portion 31X more than the circular arc obtained by extending the arcuate portion 61A, and, therefore, it becomes easy to secure the separated distance from the first angle portion 31X and the surroundings thereof, which contributes to space savings in regard of the internal volume of the cutout portion 61. Similarly, the second cutout portion 61C is connected to the crankcase bottom surface portion 24 at the position P2 spaced from the second angle portion 31Y more than the circular arc obtained by extending the arcuate portion 61A, and, therefore, it is facilitated to secure the separated distance from the second angle portion 31Y and the surroundings thereof, which contributes to space savings as to the internal volume of the cutout portion 61.

Besides, the bearing cap 31 has the bolt holes 33B (FIG. 4) the axial direction of which is along the direction in which the bearing cap 31 is press fitted to the crankcase 12. This ensures that when the press-fitted bearing cap 31 is drawn out, the fastening bolts 41A (FIG. 6) for grasping the bearing cap 31 can be fastened.

In addition, the bolt holes 33B are coaxial with the through-hole portions 33 (FIG. 4) through which the fastening bolts 41 (FIG. 4) for fastening the bearing cap 31 and the crankcase 12 to each other are passed, and the bolt holes 33B are greater in diameter than the fastening bolts 41. Note that in FIG. 7, reference symbol LL denotes an axis (common axis) which is common to the bolt hole 33B, the through-hole portion 33, and the knock pin hole portion 33N.

Accordingly, the through-hole portion 33 and the bolt hole 33B can be provided on a combined use basis. Accordingly, it is easy to maintain the rigidity of the bearing cap 31, as compared to the case where the through-hole portions 33 and the bolt holes 33B are provided independently from each other.

The above-described embodiment is merely an embodiment of the present invention, and various modifications and applications are possible without departing from the scope of the gist of the invention.

For instance, while a case where the crankcase 12 is made of an aluminum alloy and the bearing cap 31 is made of steel has been described in the above embodiment, the materials may be changed as required. Besides, while a case where the present invention is applied to the power unit 10 of a motorcycle has been described in the above embodiment, the application of the invention is not limited to this, and the invention may be applied to various power units of four-wheel vehicles and the like.

DESCRIPTION OF REFERENCE SYMBOLS

10 Power unit
12 Crankcase
15 Crankshaft
16 Main shaft
17 Counter shaft
18 Output shaft
19 Generator shaft
21 Journal wall
31 Bearing cap
31X First angle portion
31Y Second angle portion
33, 40, 85 Through-hole portion
33B Bolt hole
34 Bearing cap bottom surface portion
36 Bearing cap side wall portion
41, 41A, 54, 56 Fastening bolt (Fastening member)
61 Cutout portion
61A Arcuate portion
61B First cutout portion (Rectilinear portion)
61C Second cutout portion (Another rectilinear portion)
81 Attaching/detaching jig
82 First jig
83 Second jig
AR1 Angle region of bearing cap
AR2 Corner region of journal wall

The invention claimed is:

1. A crankshaft support structure comprising a bearing cap press fitted and fastened to a crankcase, with a crankshaft rotatably supported between the crankcase and the bearing cap, wherein the bearing cap includes a bearing cap side wall portion such that a press-fit load is exerted between the crankcase and the bearing cap side wall portion when the bearing cap is press fitted to the crankcase, and a bearing cap bottom surface portion making contact with the crankcase when the bearing cap is press fitted to the crankcase, a first angle portion where part of the bearing cap side wall portion is cut out and a second angle portion where part of the bearing cap bottom surface portion is cut out are formed in a region including a part where respective extension portions of the bearing cap side wall portion and the bearing cap bottom surface portion intersect each other, the crankcase includes a crankcase side wall portion making contact with the bearing cap side wall portion, and a crankcase bottom surface portion making contact with the bearing cap bottom surface portion, with a gap provided between the crankcase side wall portion and the first angle portion and between the crankcase bottom surface portion and the second angle portion, the crankcase is formed with a cutout portion having an arcuate portion cut out in an arcuate shape to secure the gap from the first angle portion to the second angle portion, the cutout portion formed in a part where respective extension portions of the crankcase side wall portion and the crankcase bottom surface portion intersect each other, a portion of the cutout portion which interconnects the crankcase side wall portion and one end of the arcuate portion is a first rectilinear portion which is interconnected to a position that is spaced from the first angle portion and which extends linearly to a side separated from the first angle portion in a first fixed inclination angle, a portion of the cutout portion which interconnects the crankcase bottom surface portion and another end of the arcuate portion is a second rectilinear portion which is interconnected to a position that is spaced from the second angle portion and which extends linearly to a side separated from the second angle portion in a second fixed inclination angle, and the one end of the arcuate portion and the crankcase side wall portion are separated by the first angle portion and the another end of the arcuate portion and the crankcase bottom surface portion are separated by the second angle portion.

2. The crankshaft support structure according to claim 1, wherein the first rectilinear portion is connected to the crankcase side wall portion at a position spaced from the first angle portion more than a circular arc obtained by extending the arcuate portion.

3. The crankshaft support structure according to claim 1, wherein the second rectilinear portion is connected to the crankcase bottom surface portion at a position spaced from the second angle portion more than a circular arc obtained by extending the arcuate portion.

4. The crankshaft support structure according to claim 1, wherein the bearing cap has a bolt hole an axial direction of which is along a direction in which the bearing cap is press fitted to the crankcase.

5. The crankshaft support structure according to claim 4, wherein the bolt hole is coaxial with a through-hole portion through which a fastening bolt for fastening the bearing cap and the crankcase to each other is passed, and the bolt hole is greater in diameter than the fastening bolt.

6. The crankshaft support structure according to claim 1, wherein the rectilinear portion is connected to the crankcase side wall portion at a position spaced from the first angle portion more than a circular arc obtained by extending the arcuate portion.

7. The crankshaft support structure according to claim 2, wherein the bearing cap has a bolt hole an axial direction of which is along a direction in which the bearing cap is press fitted to the crankcase.

8. The crankshaft support structure according to claim 3, wherein the bearing cap has a bolt hole an axial direction of which is along a direction in which the bearing cap is press fitted to the crankcase.

9. The crankshaft support structure according to claim 6, wherein the bearing cap has a bolt hole an axial direction of which is along a direction in which the bearing cap is press fitted to the crankcase.

10. The crankshaft support structure according to claim 7, wherein the bolt hole is coaxial with a through-hole portion through which a fastening bolt for fastening the bearing cap and the crankcase to each other is passed, and the bolt hole is greater in diameter than the fastening bolt.

11. The crankshaft support structure according to claim 8, wherein the bolt hole is coaxial with a through-hole portion through which a fastening bolt for fastening the bearing cap and the crankcase to each other is passed, and the bolt hole is greater in diameter than the fastening bolt.

12. The crankshaft support structure according to claim 9, wherein the bolt hole is coaxial with a through-hole portion through which a fastening bolt for fastening the bearing cap and the crankcase to each other is passed, and the bolt hole is greater in diameter than the fastening bolt.

* * * * *